US005479785A

United States Patent [19]

Novak

[11] Patent Number: 5,479,785

[45] Date of Patent: Jan. 2, 1996

[54] ELECTRONIC DEFROST CONTROLLER WITH FAN DELAY AND DRIP TIME MODES

[75] Inventor: Robert M. Novak, Manitowoc, Wis.

[73] Assignee: Paragon Electric Company, Inc., Two Rivers, Wis.

[21] Appl. No.: 194,107

[22] Filed: Feb. 8, 1994

[51] Int. Cl.[6] ..... F25D 21/08

[52] U.S. Cl. ..... 62/155; 62/156; 62/158; 62/182; 62/234

[58] Field of Search ..... 62/151, 155, 156, 62/157, 158, 180, 182, 231, 234

[56] References Cited

U.S. PATENT DOCUMENTS

| | | | |
|---|---|---|---|
| 2,492,970 | 1/1950 | Curry | 62/182 X |
| 2,953,908 | 9/1960 | Petrone et al. | 62/158 |
| 4,663,941 | 5/1987 | Janke | 62/156 |
| 4,843,831 | 7/1989 | Yamada | 62/155 |
| 4,843,833 | 7/1989 | Polkinghorne | 62/180 |
| 4,951,473 | 8/1990 | Levine et al. | 62/158 X |
| 4,993,233 | 2/1991 | Borton et al. | 62/155 |
| 5,161,383 | 11/1992 | Hanson et al. | 62/81 |
| 5,231,844 | 8/1993 | Park | 62/80 |
| 5,237,830 | 8/1993 | Grant | 62/155 |

*Primary Examiner*—Harry B. Tanner
*Attorney, Agent, or Firm*—Foley & Lardner

[57] ABSTRACT

An apparatus controls an appliance, the appliance including a compressor, a fan, and a heater. The apparatus includes a first switch for selectively coupling a first terminal with one of a second terminal and a third terminal in response to a first control signal. The first terminal is coupled with an energy source and the third terminal is coupled with the compressor. The apparatus further includes a second switch for selectively coupling the second terminal with the heater and the third terminal with the fan in response to a second control signal. The apparatus still further includes a control circuit coupled with the first switch and the second switch for generating the first control signal and the second control signal. A relay drive circuit couples relay coils in series to control the first switch, the second switch, and the third switch. A bypass switch allows a single current to selectively energize one or both relay coils.

31 Claims, 2 Drawing Sheets

ELECTRONIC DEFROST CONTROLLER WITH FAN DELAY AND DRIP TIME MODES

BACKGROUND OF THE INVENTION

The present invention is generally directed to an apparatus for controlling an appliance, the appliance including a compressor, a fan, and a heater. More particularly, the preferred embodiment of the present invention is directed to a defrost controller for selectively completing a circuit from an energy source through at least one of a heater, a fan, and a compressor.

Appliances such as refrigerators and freezers generally operate in one of a plurality of operating modes. Such devices generally include a compressor coupled with an evaporator for cooling air, a fan for circulating cool air throughout the device, and a defrost heater for defrosting the coils of the evaporator. A control circuit selectively couples one or more of these components to an energy source such as a power supply to operate in one of the plurality of operating modes.

In a first operating mode, the compressor and the fan are coupled to the energy source and operate to cool the air in the appliance and circulate the cool air throughout the device. In a second operating mode, the defrost heater is coupled to the energy source and operates to defrost the evaporator when a predetermined frost load has accumulated on the evaporator. For maximizing efficient utilization of energy, the cooling mode and the defrost mode of operation are mutually exclusive. It is inefficient to try to cool air in the appliance and defrost at the same time.

A third operating mode is drip time. For a predetermined time after the defrost heater is deenergized, but before the compressor is energized, each of the defrost heater, the compressor, and the fan are decoupled from the energy source to allow moisture to drip from the evaporator coils. Drip time may be approximately two minutes in duration. Removal of moisture from the evaporator coils reduces ice formation on the coils during a subsequent cooling cycle. Ice on the evaporator coils insulates the coils and renders heat exchanging less efficient during cooling cycles. It is for the very purpose of removing such ice buildup that defrosting is effected.

A fourth operating mode, fan delay, preferably follows the drip time operating mode. During fan delay, only the compressor is coupled to the energy source. This allows air around the evaporator coils to cool prior to coupling the fan to the energy source to circulate the cool air. Fan delay improves performance of the appliance by permitting only the circulation of cool air, and not air which has been warmed during the defrost cycle. Fan delay time may be ten to fifteen minutes in duration.

Following the fan delay, the fan, along with the compressor, is coupled with the energy source and the cooling operating mode (first operating mode) begins. Under control of the control circuit, the appliance cycles repetitively among the four operating modes.

Prior art defrost controllers are not well adapted to providing all four modes of operation. Prior art defrost controllers include a single control output for controlling a single relay. The single pole, dual throw relay selects between a compressor run mode for cooling or a defrost mode. Fan delay and drip time modes are controlled through external devices or are not available.

Prior art defrost controller circuits include a circuit for energizing and deenergizing the relay coil of the relay used for mode selection. The defrost controller provides a current to the relay coil to energize the relay coil to select one of the cooling mode or the defrost mode. The defrost controller removes the current from the relay coil to deenergize the relay coil and select the other of the cooling mode or defrost mode.

Some defrost controller circuits control more than a single relay. These defrost controllers have high part counts and use considerable electrical energy to control more than one relay. Prior art relay control circuits generally provide a single current path for energizing the relay coil of each relay to be controlled. Prior art appliance controllers have lacked a way to control multiple relays in an appliance using a single current path.

The present invention overcomes these limitations and provides other advantages over the prior art. The present invention provides an apparatus which readily couples a compressor, a fan, and a heater to an energy source to provide positive operational control of the apparatus in any one of a plurality of operating modes, such as the four operating modes described above.

Summary of the Invention

The invention provides an apparatus for controlling an appliance. In the preferred embodiment, the apparatus is configured to control an appliance including a compressor, a fan, and a heater. The apparatus includes a first switch means for selectively coupling a first terminal with one of a second terminal and a third terminal in response to a first control signal, the first terminal being coupled with an energy source and the third terminal being coupled with the compressor. The apparatus further includes second switch means for selectively coupling the second terminal with the heater and the third terminal with the fan in response to a second control signal. The apparatus still further includes control means coupled with the first switch means and the second switch means for generating the first control signal and the second control signal.

In a preferred embodiment, the apparatus further includes a first relay coil and a second relay coil. The first switch means includes a first relay coil and a first switch. The first switch operates in response to the first relay coil being energized and deenergized. The second switch means includes a second relay coil and a second switch and a third switch. The second switch and third switch preferably operate in response to the second relay coil being energized and deenergized. Further in the preferred embodiment, the first relay coil and the second relay coil are coupled in series.

The invention still further provides a defrost controller for selectively completing a circuit from an energy source through at least one of a heater, a fan, and a compressor. The defrost controller includes first switch means including a first switch coupled with the energy source for selectively coupling one of a first locus and a second locus with the energy source in response to a first control signal, the compressor being coupled with the second locus, the first switch means coupling the second locus with the energy source to complete the circuit through the compressor. The defrost controller further comprises second switch means including a second switch coupled with the first locus and the heater for selectively coupling the circuit through the heater in response to a second control signal, and a third switch coupled with the second locus and the fan for selectively completing the circuit through the fan in response to the second control signal. The defrost controller still further includes control means coupled with the first switch means and the second switch means for generating the first control signal and the second control signal.

The invention still further provides a defrost controller for selectively operating an appliance in one of a plurality of operating modes, the defrost controller being coupled with an energy source, the appliance including a compressor, a fan, and a heater. The defrost controller comprises first switch means coupled with the energy source for selectively coupling one of a first circuit and a second circuit with the energy source in response to a first control signal, the first circuit including the heater and the second circuit including the fan and the compressor. The defrost controller further comprises second switch means coupled with the first switch means and the first circuit for selectively coupling the first circuit with the first switch means in response to a second control signal. The defrost controller still further includes third switch means coupled with the first switch means and the fan for selectively coupling the fan to the first switch means in response to the second control signal. The defrost controller still further includes control means coupled with the first switch means, the second switch means and the third switch means for selectively generating the first control signal and the second control signal to establish a plurality of operating modes. In a first operating mode, only the compressor and the fan are coupled with the energy source. In a second operating mode, only the heater is coupled with the energy source. In a third operating mode, only the compressor is coupled with the energy source. And, in a fourth operating mode, the compressor, the fan, and the heater are decoupled from the energy source.

The invention still further provides a defrost controller for selectively operating an appliance in one of a plurality of operating modes, the defrost controller completing a circuit from an energy source through at least one of a first component, a second component, and a third component. The defrost controller includes a first switch coupled with the energy source for selectively coupling one of a first locus and a second locus with the energy source in response to a first control signal. The first component is coupled with the second locus, and the first switch couples the second locus with the energy source to complete the circuit through the first component. The defrost controller further includes a second switch coupled with the first locus and a second component for selectively completing the circuit through the second component in response to a second control signal. The defrost controller still further provides a third switch coupled with the second locus and the third component for selectively completing the circuit through the third component in response to a third control signal. The defrost controller still further provides control means coupled with the first switch, the second switch, and the third switch for selectively generating the first control signal, the second control signal, and the third control signal to establish the plurality of operating modes. In a first operating mode, only the first component and the third component are coupled with the energy source. In a second operating mode, only the second component is coupled with the energy source. In a third operating mode, only the first component is coupled with the energy source, and, in a fourth operating mode, the first component, the second component, and the third component are decoupled from the energy source.

It is, therefore, an advantage of the present invention to provide an apparatus for selectively coupling a compressor, a fan, and a heater to an energy source to provide one of four modes of operation.

A further advantage of the present invention is to provide control of an appliance in one of four modes of operation while minimizing the hardware required for controlling the appliance.

Yet a further object of the present invention is to provide an apparatus for controlling an appliance while minimizing the current required for coupling components such as a compressor, a fan, and a heater to an energy source.

Further objects and features of the present invention will be apparent from the following specification and claims when considered in connection with the accompanying drawings illustrating the preferred embodiment of the present invention.

DETAILED DESCRIPTION OF THE INVENTION

Figure 1:
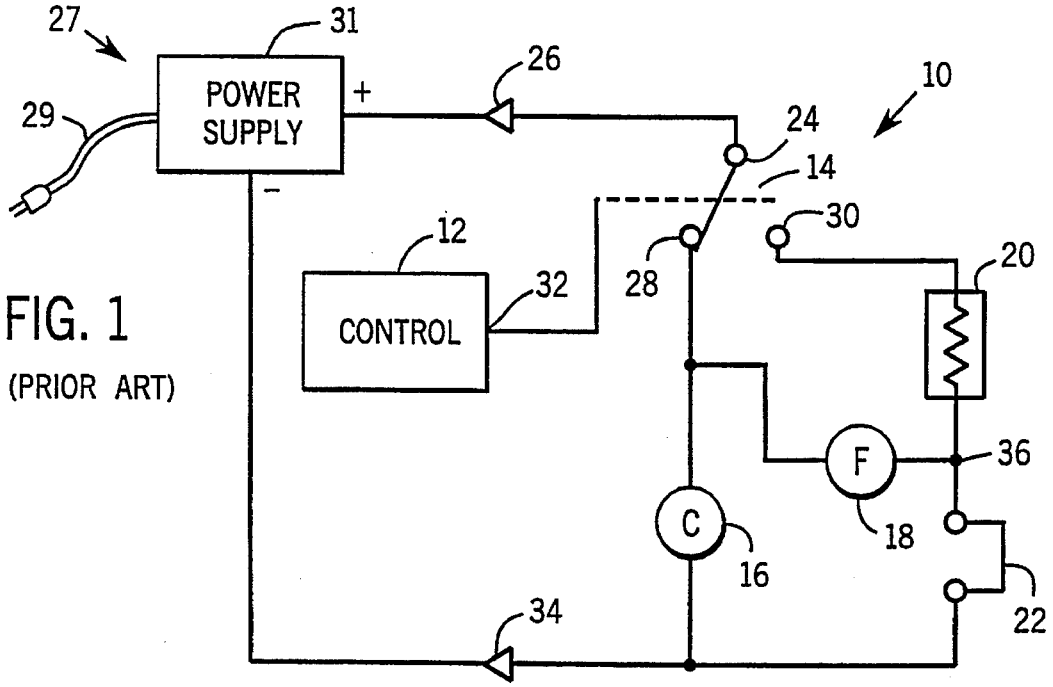
FIG. 1 (PRIOR ART)
FIG. 1 is a schematic diagram of a prior art defrost controller.

FIG. 1 is a schematic diagram of a prior art defrost controller. In FIG. 1, the defrost controller 10 includes a control circuit 12, a relay switch 14, a compressor 16, a fan 18, a defrost heater 20, and a bimetal switch 22.

The relay switch 14 has a first terminal 24 coupled to a first terminal 26 of an energy source 27. The energy source 27 may be the alternating current (AC) line cord 29 which supplies electrical power to the appliance or a power supply 31 which converts AC power received from the line cord to power which may be used by the appliance. Alternatively, the energy source 27 may be any component or connection which supplies electrical power to the prior art defrost controller 10. The relay switch 14 also has a second terminal 28 and a third terminal 30. The relay switch 14 responds to a control signal supplied at a control output 32 of the control circuit 12 to selectively couple the first terminal 24 to one of the second terminal 28 and the third terminal 30. For example, the control signal may cause a relay coil (not shown) associated with the relay switch 14 to be energized or deenergized and selectively couple the first terminal 24 with the second terminal 28 or the third terminal 30.

The compressor 16 is coupled between the second terminal 28 and a second terminal 34 of the energy source 27. The defrost heater 20 is coupled to the third terminal 30 and a node 36. The bimetal switch 22 is coupled between the node 36 and the second terminal 34 of the energy source 27. The bimetal switch 22 is of the type which closes in the presence of relatively cool temperatures to form a connection between the node 36 and the second terminal 34 of the energy source, and which opens in the presence of relatively warm temperature to break the connection between the node 36 and the second terminal 34 of the energy source. The fan 18 is coupled between the second terminal 28 and the node 36.

The prior art defrost controller 10 illustrated in FIG. 1 initiates a cooling mode of operation by configuring the relay switch 14, in response to a control signal supplied at the control output 32, to couple the first terminal 24 with the second terminal 28. This configuration of the relay switch 14 completes a circuit between the energy source 27 and the compressor 16. To operate in a defrost mode of operation, the prior art defrost controller 10 configures the relay switch 14 to couple the first terminal 24 to the third terminal 30, completing a circuit between the energy source 27 and the defrost heater 20. The defrost cycle is completed when the bimetal switch 22 opens at a predetermined temperature, breaking the circuit between the energy source 27 and the defrost heater 20. Alternatively, the defrost cycle is terminated when the relay switch 14, in response to a control signal at the control output 32, decouples the third terminal 30 from the first terminal 24 and couples the second terminal 28 to the first terminal 24.

When the defrost mode of operation is terminated by the bimetal switch 22 opening to break the circuit between the defrost heater 20 and the energy source 27, a drip mode of operation can be achieved by the prior art defrost controller 10 by remaining in the defrost mode with the bimetal switch 22 open. The relay switch 14 continues to couple the first terminal 24 with the third terminal 30. Because the bimetal switch 22 is open, no current may flow through the defrost heater 20 so heating does not occur. However, time of termination of the drip mode by the prior art defrost controller 10 is uncertain because closure of the bimetal switch 22 is not subject to independent control.

When the defrost mode is terminated by the bimetal switch 22 opening, no fan delay mode of operation is available with the prior art defrost controller 10. To complete a circuit between the energy source 27 and the fan 18, the relay switch 14 must couple the first terminal 24 to the second terminal 28 and the bimetal switch 22 must be closed. A fan delay mode could occur if the relay switch 14 couples the first terminal 24 with the second terminal 28 while the bimetal switch 22 is still open. In this case, the compressor 16 will run as soon as the relay switch closes, but the fan 18 will not run until the bimetal switch 22 closes. However, since the bimetal switch 22 is not subject to independent control, the duration of the fan delay mode is uncertain.

Figure 2:
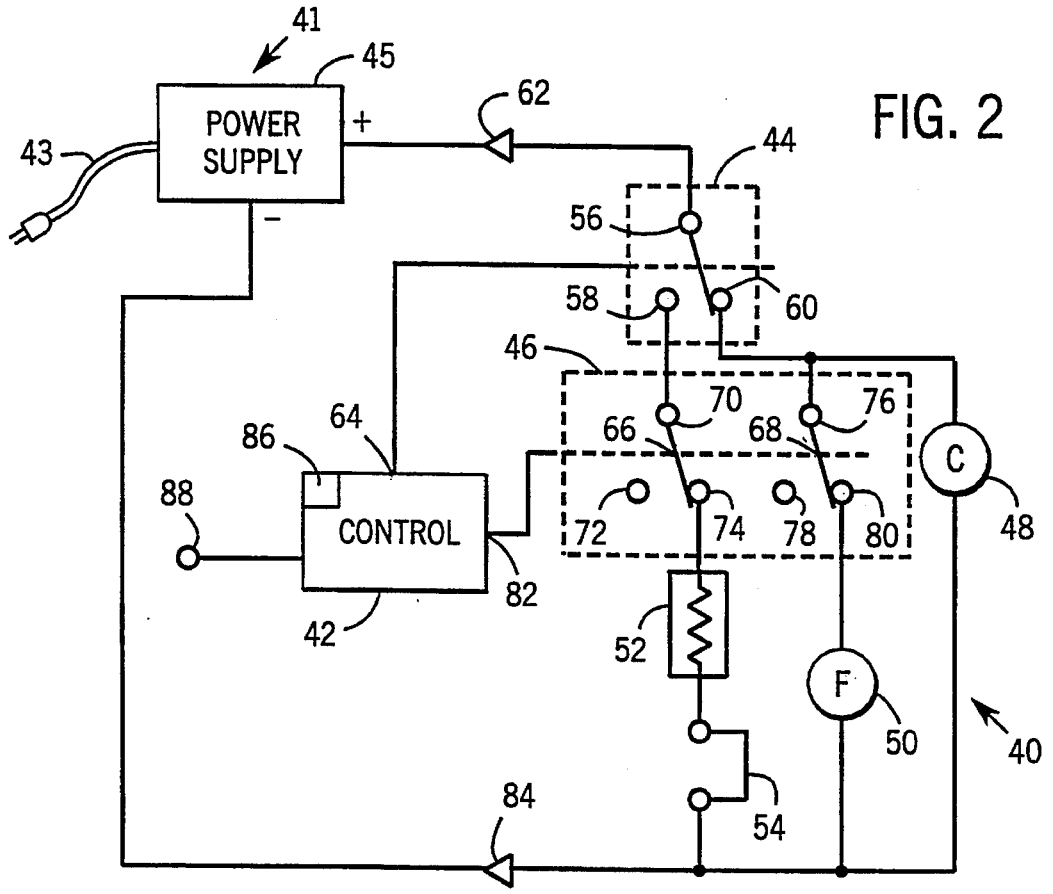
FIG. 2 is a schematic diagram of a defrost controller embodying the present invention.

FIG. 2 is a schematic diagram of a defrost controller 40 embodying the present invention. The defrost controller 40 includes a control circuit 42, a first relay switch 44, a second relay switch circuit 46, a compressor 48, a fan 50, and a heater 52. The defrost controller 40 may include a bimetal switch 54. However, in accordance with the present invention, the bimetal switch 54 is not necessary for operation of the defrost controller 40; it is shown in FIG. 2 only to illustrate its placement in defrost controller 40 if it were used. The defrost controller 40 is preferably used to control operating cycles of an appliance such as a refrigerator or freezer.

The defrost controller 40 is adapted to be coupled with an energy source 41. The energy source 41 may be the alternating current (AC) line cord 43 which supplies power to the appliance or a power supply 45 which converts AC power received from the line cord to power which may be used by the appliance. Alternatively, the energy source 41 may be any component or connection which supplies electrical power to the defrost controller 40.

The first relay switch 44 selectively couples a first terminal 56 with one of a second terminal 58 and a third terminal 60, in response to a control signal received from the first control output 64 of the control circuit 42. The first terminal 56 is coupled to a first terminal 62 of the energy source 41. The second relay switch circuit 46 preferably includes a second relay switch 66 and a third relay switch 68. The second relay switch 66 couples a first terminal 70 to one of a second terminal 72 and a third terminal 74. The third relay switch 68 couples a first terminal 76 to one of a second terminal 78 and a third terminal 80. Preferably, both the second relay switch 66 and the third relay switch 68 operate in response to a control signal provided at the second control output 82 of the control circuit 42. As is understood by those skilled in the art, the second relay switch 66 and the third relay switch 68 may be independently controlled by separate control signals from the control circuit 42.

The defrost heater 52 is coupled to the third terminal 74 of the second relay switch 66. As indicated above, the bimetal switch 54 may be coupled between the defrost heater 52 and a second terminal 84 of the energy source 41. The fan 50 is coupled between the third terminal 80 of the third relay switch 68 and the second terminal 84 of the energy source 41. The compressor 48 is coupled between the third terminal 60 of the first relay switch 44 and the second terminal 84 of the energy source 41.

Table I illustrates how the first relay switch 44, the second relay switch 66, and the third relay switch 68 may be configured in response to control signals provided by the control circuit 42 to provide operation in one of four operating modes. As illustrated in FIG. 2, each of the first relay switch 44, the second relay switch 66, and the third relay switch 68 is shown in the "off" position, corresponding to the listings in Table I.

TABLE I

| First Relay Switch | Second and Third Relay Switches | Operating Mode |
|---|---|---|
| off | off | cooling |
| on | off | defrost |
| off | on | fan delay |
| on | on | drip |

The control circuit 42 includes a circuit 86 for establishing a plurality of operating modes for the defrost controller 40. In response to the circuit 86, the control circuit 42 generates a first control signal at the first control output 64 and a second control signal at the second control output 82. It is noted that the precise configuration of switches and components illustrated in FIG. 2 and Table I is exemplary only and variations thereof are within the scope of the present invention. For example, the first relay switch 44, the second relay switch 66, and the third relay switch 68 could be normally open or normally closed switches responsive to control signals provided by the control circuit 42. Further, the first relay switch 44 and the second relay switch 66 could also be bidirectional relays which respond to control signals of opposite polarities to effect different connections. Alternatively, these relay switches could be semiconductor devices such as transistors.

In a first operating mode, the control means 42 generates a first control signal at the first control output 64 to couple the first terminal 56 with the third terminal 60 and generates a second control signal at the second control output 82 to couple the third terminal 60 with the fan 50. In the first operating mode, a circuit is completed from the energy source 41 through both the fan 50 and the compressor 48. The first operating mode corresponds to a cooling mode of operation.

In a second mode of operation, the control circuit 42 generates a first control signal at the first control output 64 to couple the first terminal 56 with the second terminal 58. The control circuit 42 also generates a second control signal at the second control output 82 to couple the second terminal 58 with the heater 52. In the second mode of operation, a circuit is completed between the energy source 41 and the heater 52. In the second mode of operation, the compressor 48 and the fan 50 are decoupled from the energy source 41. The second mode of operation corresponds to a defrost operating mode.

As indicated above, the bimetal switch 54 may be optionally included in the circuit completed between the energy source 41 and the defrost heater 52. When included, the bimetal switch 54 provides a thermal safety override for breaking the circuit between the energy source and the defrost heater 52 in the event the temperature produced by the defrost heater 52 exceeds a predetermined limit. The bimetal switch 54 is not necessary to operation of the defrost controller 40, and the defrost heater 52 may be coupled directly to the second terminal 84 of the energy source 41.

In a third operating mode, the control circuit 42 generates a first control signal at the first control output 64 to couple the first terminal 56 with the third terminal 60 and generates a second control signal at the second control output 82 to decouple the third terminal 80 of the third relay switch 68 from the third terminal 60 of the first relay switch 44. In the third operating mode, a circuit is completed between the energy source and the compressor 48. The third operating mode corresponds to a fan delay mode in which the compressor 48 operates to cool air within the appliance, but the fan 50 does not operate to circulate cool air within the appliance.

In a fourth operating mode, the control circuit 42 generates a first control signal at the first control output 64 to couple the first terminal 56 of the first relay switch 44 with the second terminal 60 of the first relay switch 44 and generates a second control signal at the second control output 82 to decouple the heater 52 from the second terminal 58 of the first relay switch 44. In the fourth operating mode, no circuit is completed between the energy source and any of the compressor 48, the fan 50, or the heater 52. The fourth operating mode corresponds to a drip mode in which moisture which remains on the evaporator coil (not shown) following defrosting is allowed to drip off of the evaporator coil.

The control circuit 42 may also be coupled with a temperature sensor 88, such as a thermistor. The temperature sensor 88 is preferably located on or near the evaporator coil. By monitoring the temperature of the evaporator coil, and using the apparatus illustrated in FIG. 2 in accordance with the present invention, the control circuit 42 is able to terminate defrost cycles based on either temperature or time; control fan delay based on either temperature or time; or monitor compressor run times based on evaporator temperatures. Using this information, the control circuit 42 is able to adapt compressor run times based on defrost cycle lengths.

Figure 3:
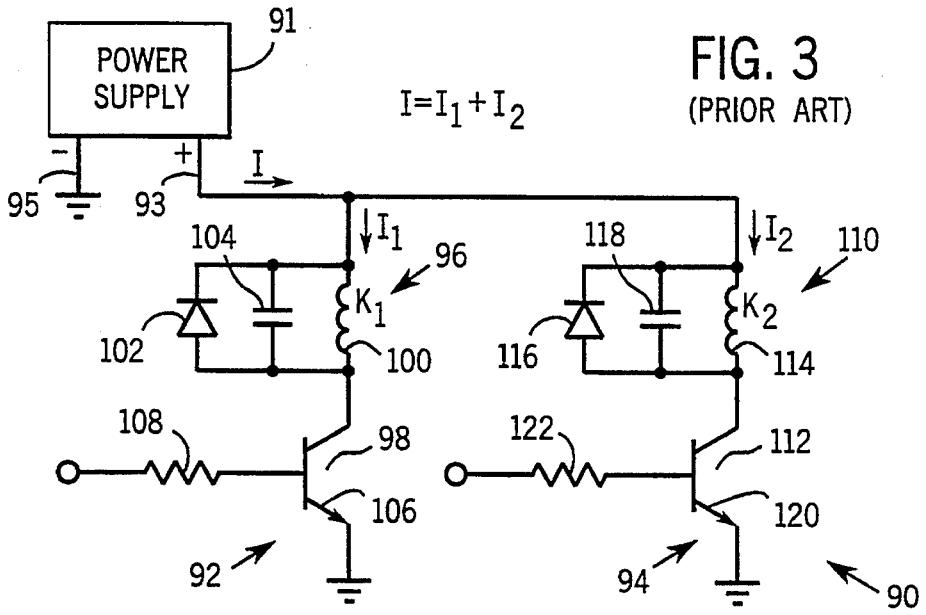
FIG. 3 (PRIOR ART)
FIG. 3 is a schematic diagram of a prior art relay drive circuit for controlling two relay switches.

FIG. 3 is a schematic diagram of a prior art relay drive circuit 90 for controlling two relay switches. The prior art relay drive circuit 90 includes a first relay energizing circuit 92 and a second relay energizing circuit 94. The prior art relay drive circuit 90 is coupled with a power supply 91. The power supply 91 has a first terminal 93 and a second terminal 95, the second terminal 95 being grounded.

The first relay energizing circuit 92 includes a first relay coil circuit 96 and a first switching device 98. The first relay coil circuit 96 includes a first relay coil 100, a first diode 102, and a first capacitor 104. When the first relay coil 100 is energized, the first relay switch 44 (FIG. 2) is in a first state; when the first relay coil 100 is deenergized, the first relay switch 44 is in a second state. The first relay coil 100 is energized by actuating the first switching device 98.

The first switching device 98 includes an NPN transistor 106 and a first resistor 108. In response to a first control signal provided by the control circuit 42 at the first control output 64 (FIG. 2), the first switching device 98 turns on to provide a current through the first relay coil 100, energizing the first relay coil 100.

The second relay energizing circuit 94 includes a second relay coil circuit 110 and a second switching device 112. The second relay coil circuit 110 includes a second relay coil 114, a second diode 116, and a second capacitor 118. The second switching device 112 preferably includes a second NPN transistor 120 and a second resistor 122. In response to a second control signal provided by the control circuit 42 at the second control output 82 (FIG. 2), the second switching device 112 turns on to provide a current through the second relay coil 114, energizing the second relay coil 114.

When the defrost controller of FIG. 2 is operating in the drip mode, both the first relay coil 100 and the second relay coil 114 must be energized at the same time. This requires supplying current from the power supply 91 through both relay coils. The prior art relay drive circuit 90 must conduct a first current $I_1$ through the first relay energizing circuit 92, and a second current $I_2$ through the second relay energizing circuit 94. The total current supplied by the energy source is equal to the sum of $I_1$ and $I_2$, and is indicated in FIG. 3 as I.

The need to supply two currents, $I_1$ and $I_2$, when operating in the drip mode of operation is a disadvantage of the prior art relay drive circuit 90. The power supply 91 and any circuit elements which convey the current I must be designed to supply both these currents. Moreover, when operating in the drip mode, the prior art relay drive circuit 90 supplies twice the current that would be supplied if one of the currents, $I_1$ or $I_2$, could be selectively supplied to energize both the first relay coil 100 and the second relay coil 114.

Figure 4:
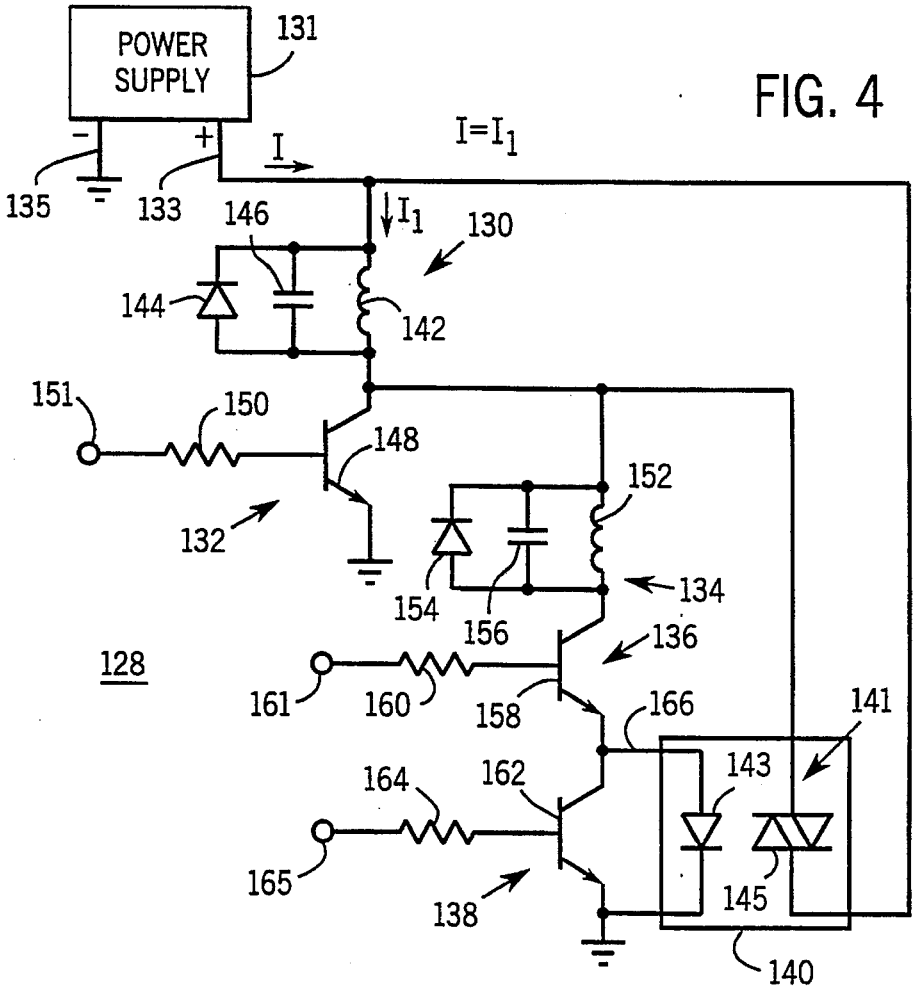
FIG. 4 is a schematic diagram of a relay drive circuit embodying the present invention for controlling two relay switches and having particular utility when used in conjunction with the defrost controller of FIG. 2.

FIG. 4 is a schematic diagram of a relay drive circuit 128 embodying the present invention for controlling two relay switches and having particular utility when used in conjunction with the defrost controller 40 of FIG. 2. The relay drive circuit 128 includes a first relay coil circuit 130, a first switching device 132, a second relay coil circuit 134, a second switching device 136, a third switching device 138, and a bypass switch 140. The relay drive circuit 128 is adapted to be coupled with a power supply 131. The power supply 131 includes a first terminal 133 and a second terminal 135, which is grounded.

The first relay coil circuit 130 preferably includes a first relay coil 142, a first diode 144, and a first capacitor 146. The first switching device 132 preferably includes a first NPN transistor 148 and a first resistor 150 coupled with a first input 151. The second relay coil circuit 134 preferably includes a second relay coil 152, a second diode 154, and a second capacitor 156. The second switching device 136 preferably includes a second NPN 158 and a second resistor 160 coupled with a second input 161. The third switching device 138 preferably includes a third NPN 162 and a third resistor 164 coupled with a third input 165.

The bypass switch 140 preferably includes an optically gated triac 141. The optically gated triac 141 includes a light emitting diode 143 and a bidirectional thyristor 145. When the light emitting diode 143 conducts current, it emits light having a predetermined frequency. The bidirectional thyristor 145 is normally in an off or blocking state. In response to the light emitted by the light emitting diode 143, the bidirectional thyristor 145 converts to an on or conducting state and provides a low resistance current path. When the light emitting diode 143 no longer conducts current, it no longer emits light, and the bidirectional thyristor 145 returns to the blocking state.

Table II illustrates operation of the relay drive circuit 128 in conjunction with the defrost controller 40 of FIG. 2 to provide a plurality of operating modes for an appliance such as a refrigerator or a freezer. In Table II, the first switching device 132, the second switching device 136, and the third switching device 138 are listed as being off, on, or X. "On" corresponds to a state in which the respective switching device is conducting current; "off" corresponds to a state in which the respective switching device is not conducting current; "X" corresponds to a "don't care" state.

TABLE II

| First Switching Device | Second Switching Device | Third Switching Device | $K_1$ | $K_2$ | Mode |
|---|---|---|---|---|---|
| off | off | X | off | off | cooling |
| on | off | X | on | off | defrost |
| off | on | off | off | on | fan delay |
| off | on | on | on | on | drip |

In a first operating mode, the control circuit 42 asserts a first relay drive switch control signal at the first input 151 to turn off the first NPN 148, and a second relay drive switch control signal at the second input 161 to turn off the second NPN 158. In this mode, the relay drive circuit 128 draws no current and the first relay coil 142 and the second relay coil 152 are deenergized. The first operating mode corresponds to a cooling mode of operation.

In a second operating mode, the control circuit 42 asserts a first relay drive switch control signal at the first input 151 to turn the first NPN transistor 148 on, and a second relay drive switch control signal at the second input 161 to turn the second NPN transistor 158 off. In the second operating mode, a current $I_1$ flows from the power supply 131 through the first relay coil 142 and through the first NPN transistor 148 to ground. Thus, only the first relay coil 142 is energized; the second relay coil 152 is deenergized. The second operating mode corresponds to a defrost mode.

In a third mode of operation, the control circuit 42 asserts a first relay drive switch control signal at the first input 151 to turn the first NPN transistor 148 off, and a second relay drive switch control signal at the second input 161 to turn the second NPN transistor 158 on. The control circuit 42 also asserts a third relay drive switch control signal at the third control input 165 to turn the third NPN transistor 162 off. In the third operating mode, turning on the second NPN transistor 158 provides current to a control input 166 of the bypass switch 140. This current causes the light emitting diode 143 to emit light, turning on the bidirectional thyristor 145, to provide a low-resistance current path from the power supply 131 directly to the second relay coil 152. Thus, a current $I_1$ flows from the power supply 131 through the bidirectional thyristor 145, through the second relay coil 152, through the second NPN transistor 158, and to the control input 166 of the bypass switch 140 to ground. In the third operating mode, the second relay coil 152 is energized and the first relay coil 142 is deenergized. The third operating mode corresponds to a fan delay mode.

The bypass switch 140 could include an electronically gated triac, a silicon controller rectifier (SCR) or a phototransistor in place of the optically gated triac 141. The optically gated triac 141 is preferably used because of the large potential differences which may exist in the relay drive circuit 128. For example, the light emitting diode 143 is coupled to ground while the bidirectional thyristor 143 is coupled to the first terminal 133 of the power supply 131, creating a potential difference across the bypass switch of as much as 50 volts. Use of an optically coupled device, such as optically gated triac 141, eliminates the need to use more robust, and more expensive, devices capable of operating at such large potential differences.

In a fourth operating mode, the control circuit 42 asserts a first relay drive switch control signal at the first control input 151 to turn off the first NPN transistor 148, a second relay drive switch control signal at the second control input 161 to turn on the second NPN transistor 158, and a third relay drive switch control signal at the third control input 165 to turn on the third NPN transistor 162. In the fourth operating mode, a current $I_l$ flows from the power supply 131 through the first relay coil 142, through the second relay coil 152, through the second NPN 158, and through the third NPN 162 to ground. Thus, the first relay coil 142 and the second relay coil 152 are both energized. The fourth operating mode corresponds to a drip mode of operation.

As can be seen, the relay drive circuit 128 of the present invention provides distinct advantages over the prior art relay drive circuit illustrated in FIG. 3. In any operating mode, the current drawn by the relay drive circuit 128 is substantially one-half the current required by the prior art relay drive circuit 90. Such reduced current requirements permit use of a smaller power supply and improve the overall energy efficiency of the system. Since power varies as the square of current, the relay drive circuit 128 will dissipate substantially one-fourth the power dissipated by the prior art relay drive circuit 90 when operated with both relay coils energized. As shown in FIG. 4, the relay drive circuit 128 also uses the relay coil current to activate the bypass switch 140, further reducing part counts, cost, and power supply requirements.

It is to be understood that, while the detailed drawings and specific examples given describe preferred embodiments of the invention, they are for the purpose of illustration only, that the apparatus of the invention is not limited to the precise details and conditions disclosed, and that various changes may be made therein without departing from the spirit of the invention which is defined by the following claims.

I claim:

1. An apparatus for controlling an appliance, said appliance including a compressor, a fan, and a heater; the apparatus comprising:

first switch means for selectively coupling a first terminal with one of a second terminal and a third terminal in response to a first control signal, said first terminal being coupled with an energy source, said third terminal being coupled with said compressor;

second switch means for selectively coupling said second terminal with said heater and said third terminal with said fan in response to a second control signal; and control means coupled with said first switch means and said second switch means for generating said first control signal and said second control signal.

2. An apparatus for controlling an appliance as recited in claim 1 wherein said control means includes means for establishing a plurality of operating modes for the apparatus, said control means generating said first control signal to couple said first terminal with said third terminal and generating said second control signal to couple said third terminal with said fan to establish a first operating mode for the apparatus.

3. An apparatus for controlling an appliance as recited in claim 2 wherein said control means further generates said second control signal to decouple said heater from said second terminal and said fan from said third terminal to establish said first operating mode.

4. An apparatus for controlling an appliance as recited in claim 2 wherein said control means generates said first control signal to couple said first terminal with said second terminal and generates said second control signal to couple said second terminal with said heater to establish a second operating mode for the apparatus.

5. An apparatus for controlling an appliance as recited in claim 4 wherein said control means further generates said second control signal to couple said fan to said third terminal and the heater to the second terminal to establish said second operating mode.

6. An apparatus for controlling an appliance as recited in claim 4 wherein said control means generates said first control signal to couple said first terminal with said third terminal and generates said second control signal to decouple said third terminal from said fan to establish a third operating mode for the apparatus.

7. An apparatus for controlling an appliance as recited in claim 6 wherein said control means further generates said second control signal to decouple said heater from said second terminal to establish said third operating mode.

8. An apparatus for controlling an appliance as recited in claim 6 wherein said control means generates said first control signal to couple said first terminal with said second terminal and generates said second control signal to decouple said heater from said second terminal in a fourth operating mode to establish a fourth operating mode for the apparatus.

9. An apparatus for controlling an appliance as recited in claim 8 wherein said control means further generates said second control signal to decouple said fan from said third terminal to establish said fourth operating mode.

10. An apparatus for controlling an appliance as recited in claim 1 wherein said first switch means comprises a first relay coil and a first switch, said first switch coupling said first terminal with said second terminal when said first relay coil is energized, said first switch coupling said first terminal with said third terminal when said first relay coil is deenergized.

11. An apparatus for controlling an appliance as recited in claim 10 wherein said second switch means comprises a second relay coil, a second switch and a third switch, said second switch coupling said second terminal with said heater when said second relay coil is deenergized, said third switch coupling said third terminal with said fan when said first relay coil is deenergized.

12. An apparatus for controlling an appliance as recited in claim 11 wherein the apparatus further comprises first relay drive switching means coupled with said first relay coil for energizing said first relay coil in response to said first control signal and second relay drive switching means coupled with said second relay coil for energizing said second relay coil in response to said second control signal.

13. An apparatus for controlling an appliance as recited in claim 12 wherein said first relay coil and said second relay coil are coupled in series.

14. An apparatus for controlling an appliance as recited in claim 13 wherein said first relay coil is coupled between said energy source and a first node and said first relay drive switching means couples said first node to a reference potential in response to said first control signal; wherein said second relay coil is coupled between said first node and a second node and said second relay drive switching means couples said second node to a third node in response to said second control signal; and wherein the apparatus further comprises third relay drive switching means coupled with said energy source, said first node, said third node and said reference potential and responsive to a third control signal for coupling said third node with said reference potential when said third control signal is in a first state and for coupling said first node with said energy source when said third control signal is in a second state, said control means generating said third control signal.

15. A defrost controller for selectively completing a circuit from an energy source through at least one of a heater, a fan and a compressor; the defrost controller comprising:

first switch means including a first switch coupled with said energy source for selectively coupling one of a first locus and a second locus with said energy source in response to a first control signal, said compressor being coupled with said second locus, said first switch means coupling said second locus with said energy source to complete said circuit through said compressor;

second switch means including a second switch coupled with said first locus and said heater for selectively completing said circuit through said heater in response to a second control signal, and a third switch coupled with said second locus and said fan for selectively completing said circuit through said fan in response to said second control signal; and control means coupled with said first switch means and said second switch means for generating said first control signal and said second control signal.

16. A defrost controller as recited in claim 15 wherein said first switch means further includes a first relay coil, said first relay coil having one of a first relay first state and a first relay second state in response to said first control signal, said first switch coupling one of said first locus and said second locus with said energy source when said first relay coil is in said first relay first state, said first switch coupling the other of said first locus and said second locus with said energy source when said first relay coil is in said first relay second state.

17. A defrost controller as recited in claim 16 wherein said second switch means further includes a second relay coil, said second relay coil having one of a second relay first state and a second relay second state in response to said second control signal, said second switch completing said circuit through said heater only when said second relay coil is in said second relay second state.

18. A defrost controller as recited in claim 17 wherein said third switch completes said circuit through said fan only when said second relay coil is in said second relay second state.

19. A defrost controller as recited in claim 18 wherein said first relay first state corresponds to said first relay coil being energized and said second relay first state corresponds to said second relay coil being energized; and wherein the defrost controller further comprises first relay drive switching means coupled with said first relay coil for energizing said first relay coil in response to said first control signal and second relay drive switching means coupled with said second relay coil for energizing second relay coil in response to said second control signal.

20. A defrost controller as recited in claim 15 wherein said control means generates said first control signal and said second control signal to establish a plurality of operating modes; only said compressor and said fan being coupled with said energy source in a first operating mode; only said heater being coupled with said energy source in a second operating mode; only said compressor being coupled with said energy source in a third operating mode; and said compressor, said fan and said heater being decoupled from said energy source in a fourth operating mode.

21. A defrost controller for selectively operating an appliance in one of a plurality of operating modes, the defrost controller being coupled with an energy source, said appliance including a compressor, a fan and a heater; the defrost controller comprising:

first switch means coupled with said energy source for selectively coupling one of a first circuit and a second circuit with said energy source in response to a first control signal, said first circuit including said heater and said second circuit including said fan and said compressor; and second switch means coupled with said first switch means and said first circuit for selectively coupling said first circuit with said first switch means in response to a second control signal;

third switch means coupled with said first switch means and said fan for selectively coupling said fan to said first switch means in response to said second control signal; and control means coupled with said first switch means, said second switch means and said third switch means for selectively generating said first control signal and said second control signal to establish said plurality of operating modes; only said compressor and said fan being coupled with said energy source in a first operating mode; only said heater being coupled with said energy source in a second operating mode; only said compressor being coupled with said energy source in a third operating mode; and said compressor, said fan and said heater being decoupled from said energy source in a fourth operating mode.

22. A defrost controller as recited in claim 21 wherein said first switch means includes a first switch and a first relay coil, said first relay coil having one of a first relay first state and a first relay second state in response to said first control signal, said first switch coupling one of said first circuit and said second circuit with said energy source when said first relay coil is in said first relay first state, said first switch coupling the other of said first circuit and said second circuit with said energy source when said first relay coil is in said first relay second state.

23. A defrost controller as recited in claim 22 wherein said second switch means includes a second switch and wherein the defrost controller further comprises a second relay coil, said second relay coil having one of a second relay first state and a second relay second state in response to said second control signal, said second switch coupling said first circuit with said first switch means only when said second relay coil is in said second relay first state.

24. A defrost controller as recited in claim 23 wherein said third switch means includes a third switch and wherein said third switch couples said fan with said first switch means only when said second relay coil is in said second relay first state.

25. A defrost controller as recited in claim 23 wherein the defrost controller further comprises first relay drive switching means coupled with said first relay coil for energizing said first relay coil in response to said first control signal and second relay drive switching means coupled with said second relay coil for energizing said second relay coil in response to said second control signal.

26. A defrost controller for selectively operating an appliance in one of a plurality of operating modes, the defrost controller completing a circuit from an energy source through at least one of a first component, a second component and a third component; the defrost controller comprising:

a first switch coupled with said energy source for selectively coupling one of a first locus and a second locus with said energy source in response to a first control signal, said first component being coupled with said second locus, said first switch coupling said second locus with said energy source to complete said circuit through said first component;

a second switch coupled with said first locus and said second component for selectively completing said circuit through said second component in response to a second control signal;

a third switch coupled with said second locus and said third component for selectively completing said circuit through said third component in response to a third control signal; and control means coupled with said first switch, said second and said third switch for selectively generating said first control signal, said second control signal and said third control signal to establish said plurality of operating modes, only said first component and said third component being coupled with said energy source in a first operating mode, only said second component being coupled with said energy source in a second operating mode, only said first component being coupled with said energy source in a third operating mode, and decoupling said first component, said third component and said second component from said energy source in a fourth operating mode.

27. A defrost controller as recited in claim 26 wherein the defrost controller further includes a first relay coil, said first relay coil having one of a first relay first state and a first relay second state in response to said first control signal, said first switch coupling one of said first locus and said second locus with said energy source when said first relay coil is in said first relay first state, said first switch coupling the other of said first locus and said second locus with said energy source when said first relay coil is in said first relay second state.

28. A defrost controller as recited in claim 27 wherein the defrost controller further includes a second relay coil, said second relay coil having one of a second relay first state and a second relay second state in response to said second control signal, said second switch completing said circuit through said second component only when said second relay coil is in said second relay second state.

29. A defrost controller as recited in claim 28 wherein said third switch completes said circuit through said third component only when said second relay coil is in said second relay second state.

30. A defrost controller as recited in claim 29 wherein said first relay first state corresponds to said first relay coil being energized and said second relay first state corresponds to said second relay coil being energized; and wherein the defrost controller further comprises first relay drive switching means coupled with said first relay coil for energizing said first relay coil in response to said first control signal and second relay drive switching means coupled with said second relay coil for energizing second relay coil in response to said second control signal.

31. A defrost controller as recited in claim 26 wherein the defrost controller further comprises bimetal switch means coupled with said second switch for selectively breaking said circuit.

* * * * *